US010490131B2

(12) United States Patent
Chen et al.

(10) Patent No.: US 10,490,131 B2
(45) Date of Patent: Nov. 26, 2019

(54) DRIVING CONTROL CIRCUIT FOR DRIVING PIXEL DRIVING CIRCUIT AND DISPLAY APPARATUS THEREOF

(71) Applicant: Fitipower Integrated Technology (Shenzhen) Inc., Shenzhen (CN)

(72) Inventors: Yung-Hung Chen, Hsinchu (TW); Chang Zhu, Shenzhen (CN); Hong-Yun Wei, Shenzhen (CN)

(73) Assignee: Fitipower Integrated Technology (Shenzhen) Inc., Shenzhen (CN)

( * ) Notice: Subject to any disclaimer, the term of this patent is extended or adjusted under 35 U.S.C. 154(b) by 119 days.

(21) Appl. No.: 15/952,252

(22) Filed: Apr. 13, 2018

(65) Prior Publication Data

US 2019/0139491 A1 May 9, 2019

(30) Foreign Application Priority Data

Nov. 3, 2017 (CN) ..... 2017 1 1070817

(51) Int. Cl.
*G09G 3/3258* (2016.01)

(52) U.S. Cl.
CPC ... *G09G 3/3258* (2013.01); *G09G 2310/0251* (2013.01); *G09G 2320/0295* (2013.01); *G09G 2330/021* (2013.01)

(58) Field of Classification Search
None
See application file for complete search history.

(56) References Cited

U.S. PATENT DOCUMENTS

2006/0007215 A1* 1/2006 Tobita ..... G09G 3/3241 345/204
2008/0180365 A1* 7/2008 Ozaki ..... G09G 3/3233 345/76
2010/0156881 A1* 6/2010 Kohno ..... G09G 3/3233 345/213
2015/0130785 A1* 5/2015 Shin ..... G09G 3/3233 345/213
2015/0294626 A1* 10/2015 Bi ..... G09G 3/3233 345/211
2017/0004764 A1* 1/2017 Kim ..... G09G 3/3225
2017/0103703 A1* 4/2017 Bi ..... G09G 3/006
2018/0013085 A1* 1/2018 Shin ..... G02F 1/133365
2018/0053462 A1* 2/2018 Bae ..... G09G 3/2074
2019/0051251 A1* 2/2019 Hwang ..... G09G 3/3283
2019/0088180 A1* 3/2019 Cai ..... G09G 3/006

* cited by examiner

*Primary Examiner* — Priyank J Shah
(74) *Attorney, Agent, or Firm* — ScienBiziP, P.C.

(57) ABSTRACT

A driving control circuit with a compensating circuit detects pixel driving circuits in a display apparatus for compensating a threshold voltage in the pixel driving circuits. The compensating circuit electrically connects with the pixel driving circuits through a corresponding monitoring line. The pixel driving circuit sequentially operates during a detecting time period and a displaying period. Each pixel driving circuit comprises a driving transistor and an OLED. During the detecting time period, the compensating circuit charges a node in each pixel driving circuit by a constant current for speeding up a time of the detecting time period. The node is connected between a terminal of the driving transistor and the OLED in each pixel driving circuit.

16 Claims, 6 Drawing Sheets

DRIVING CONTROL CIRCUIT FOR DRIVING PIXEL DRIVING CIRCUIT AND DISPLAY APPARATUS THEREOF

FIELD

The subject matter herein generally relates to a driving control circuit for driving pixel driving circuits and a display apparatus thereof.

BACKGROUND

An active matrix organic light emitting diode (AMOLED) type display due to its higher refresh rate and its shorter response time is widely used in display apparatus. Organic light emitting diode elements are configured to emit light beams in the AMOLED type display. The AMOLED includes a plurality of pixel units and a plurality of pixel driving circuits, which correspond to the pixel units respectively. The pixel driving circuit is configured to drive the brightness of a corresponding one of the pixel units, and a driving control circuit is configured to detect the pixel driving circuits. Referring to FIG. 6, a typical pixel driving circuit and its driving control circuit for controlling the pixel driving circuit of an AMOLED display is shown. The pixel driving circuit 110*k* includes a switching transistor MN1, a driving transistor MN2, and a storage capacitor C1. The switching transistor MN1 receives a scan signal from a corresponding scan line SELi, and turns on for loading a data signal on a corresponding data line Dk when the scan signal is in an active state, such as a high level voltage. The storage capacitor C1 is being charged by the loaded data signal. When the switching transistor MN1 turns off, the storage capacitor C1 discharges and the driving transistor MN2 turns on for providing a current to the OLED, thus the OLED emits light. However, driving transistors in the pixels of the OLED display may be subject to manufacturing variations or operating variations. Due to such variations, transistor threshold voltages between different display pixels may vary. Variations in transistor threshold voltages can cause the pixels to produce amounts of light that do not match a desired image. A method for compensating the transistor threshold voltage can solve the above-mentioned light variation problem. In this method, a detecting time period is provided for detecting parameters in the pixel driving circuit, such as a threshold voltage of the driving transistor MN2, and the current provided to the OLED before a displaying period. During the detecting time period, the switching transistor MN1 turns on and loads different testing voltages for detecting the threshold voltage of the driving transistor MN2 and the current provided to the OLED, and a time of a potential of the node VSO increased to the predetermined voltage, which is connected between a gate electrode of the driving transistor MN2 and the OLED, is too long, thus a time of the detecting time period to be operated in a steady state for detecting the threshold voltage is too long.

BRIEF DESCRIPTION OF THE FIGURES

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
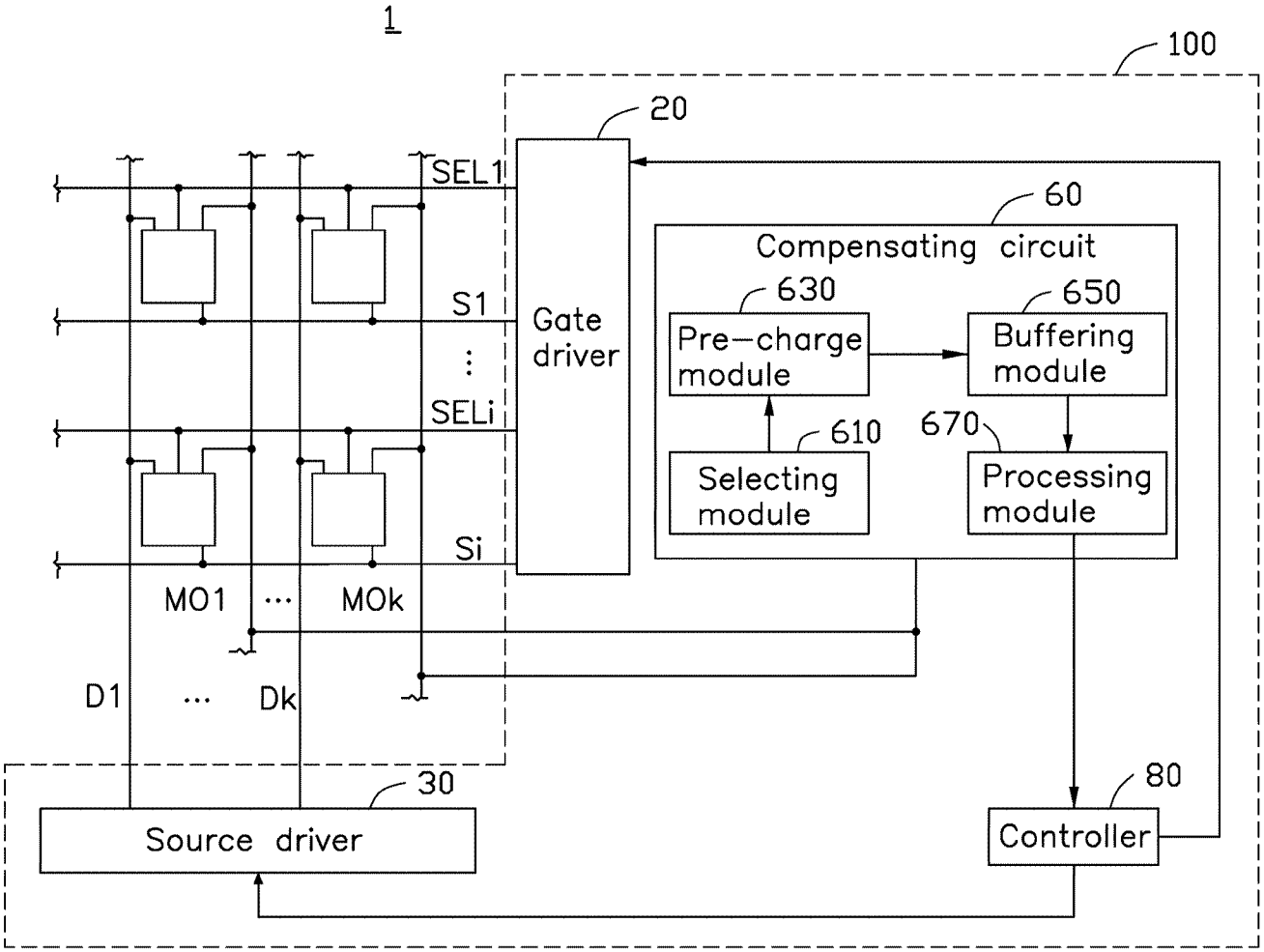
FIG. 1 is a circuit diagrammatic view of a display apparatus, the display apparatus comprises a pixel driving circuit and a driving control circuit.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "comprising," when utilized, means "including, but not necessarily limited to"; it specifically indicates open-ended inclusion or membership in the so-described combination, group, series and the like. In general, the term "module," as used herein, refers to logic embodied in hardware or firmware, or to a collection of software instructions, written in a programming language, for example, Java, C, or assembly. One or more software instructions in the modules may be embedded in firmware, such as an EPROM. It will be appreciated that modules may comprise connected logic units, such as gates and flip-flops, and may comprise programmable units, such as programmable gate arrays or processors. The modules described herein may be implemented as either software and/or hardware modules and may be stored in any type of computer-readable medium or other computer storage systems. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

The present disclosure is described in related to a driving control circuit for detecting a pixel driving circuit in a display apparatus for speeding up a detection time. In one embodiment, the driving control circuit charges the pixel driving circuit in the display apparatus before a detection operation during the detecting time period. As a result, it is possible to shorten the detection time period.

FIG. 1 illustrates an embodiment of the display apparatus 1. In this embodiment, the display apparatus 1 can be, an organic light emitting diode (OLED) display. FIG. 1 only shows a part of the pixels of the display apparatus 1 as an example and for simplicity. A pixel driving circuit (as shown in more detail in FIG. 2) in the display apparatus 1 controls luminescent characteristics of light-emitting elements in the display apparatus 1, such as brightness or a light duration of the light-emitting elements.

The pixel driving circuit can include a switching transistor, a driving transistor, a reset transistor, a storage capacitor, and a light emitting element. The pixel driving circuit sequentially operates during according to a detecting time period and a displaying period. The displaying period includes a reset period, a writing period, and a luminescent period. During the writing period, the switching transistor receives a scan signal from a scan line, and turns on when a scan signal is active, such as having a high level voltage. The data signal on a data line is provided to the storage capacitor for charging. In the emitting period, the storage capacitor discharges, and the driving transistor turns on, providing a current to the light emitting element based on a voltage from a power source, and the light emitting element emits light(s) based on the current and type of light emitting element. While the scan line is being scanned, the reset transistor turns on, and monitors the current passing through the light emitting element, and provides the current to the driving control circuit. In this embodiment, the pixel driving circuit further can operate during other periods, such as a compensating period.

The driving control circuit includes a gate driver for providing scan signals to the scan lines and a source driver for providing data signals to the data lines. In this embodiment, the driving control circuit further includes a compensating circuit. The compensating circuit sequentially charges the pixel driving circuit with a constant current before a detection operation. During the detecting time period, a detected threshold voltage of the one of the pixel driving circuit(s) generating a compensating signal.

In one embodiment, the compensating circuit includes a selecting module and a pre-charge module. The selecting module is electrically connected to all the pixel driving circuits through the monitoring lines, and sequentially selects one of the pixel driving circuits as a to-be-compensated pixel driving circuit. The pre-charge module charges the to-be-compensated pixel driving circuit.

In one embodiment, the compensating circuit further charges the monitoring lines. The pre-charge module sequentially operates during a first sub-period and a second sub-period. During the first sub-period, the pre-charge module charges the monitoring lines. During the second sub-period, the pre-charge module charges the to-be-compensated pixel driving circuit.

In one embodiment, the driving control circuit further includes a buffering module and a processing module. The buffering module is electrically connected to the pixel driving circuits through a corresponding monitoring line, and buffers a sensing current or a sensing voltage generated by the pixel driving circuits based on a driving voltage. The processing module processes the sensing current or the sensing voltage in the buffering module, detecting a threshold voltage of the driving transistor.

In one embodiment, the detecting time period is a blanking time period, which is a time period between two adjacent display frames.

In one embodiment, the detecting time period is an initial time period during which the display apparatus is powered on.

In one embodiment, the driving control circuit further includes an interfacing circuit. The compensating circuit and the interfacing circuit can be integrated in an analog-to-data converter (ADC) chip. The interfacing circuit establishes a transmitting path between the compensating circuit and a controller for transmitting signals. For example, the interfacing circuit can be a low voltage differential signaling (LVDS) interfacing circuit or a serial peripheral interface (SPI). The controller receives the specified threshold voltage parameter from the compensating circuit, and outputs scan control signals for the scan lines, data driving signals for the data lines, and clock synchronization signals for the ADC chip. The source driver compensates the driving voltage provided to the data lines based on the compensating signal for preventing a current passing through the OLED from being effected. The compensating circuit can serve as an active front end (AFE) of the ADC chip.

Figure 6:
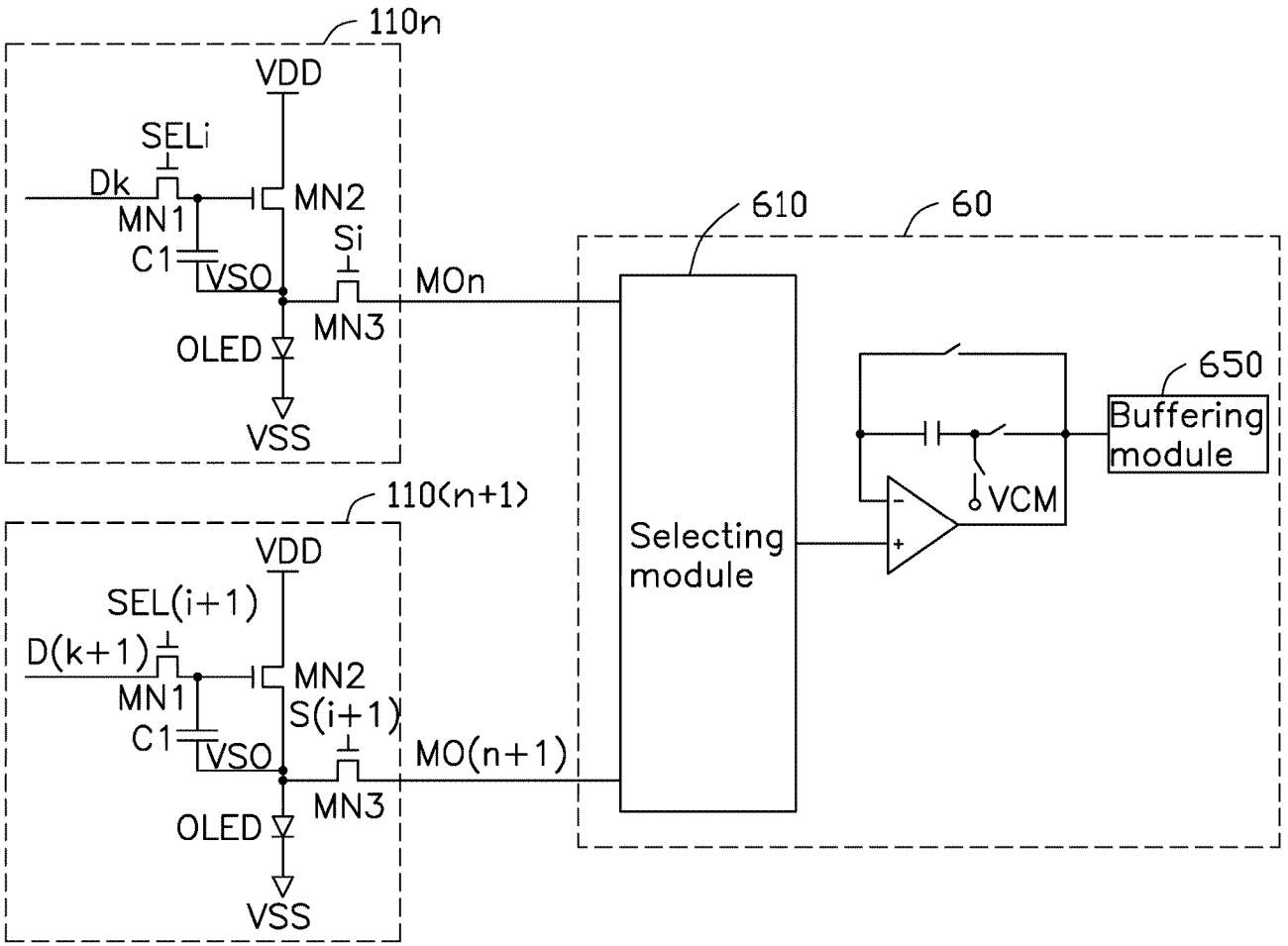
FIG. 6(RELATED ART)
FIG. 6 is a circuit diagrammatic view of the pixel driving circuits and the driving control circuit in a related art.

FIG. 6 is the driving control circuit in related art. The elements with the same labels indicate the same elements in the current embodiment. In the related art, the compensating circuit in the driving control circuit directly detects the threshold voltage of the driving transistor during the detecting time period for generating the compensating signal. As shown, a voltage of the first node VSO increases from 0 to a predetermined voltage during the detecting time period, thus the detecting time period to operated in a steady state for detecting the threshold voltage is too long.

Figure 2:
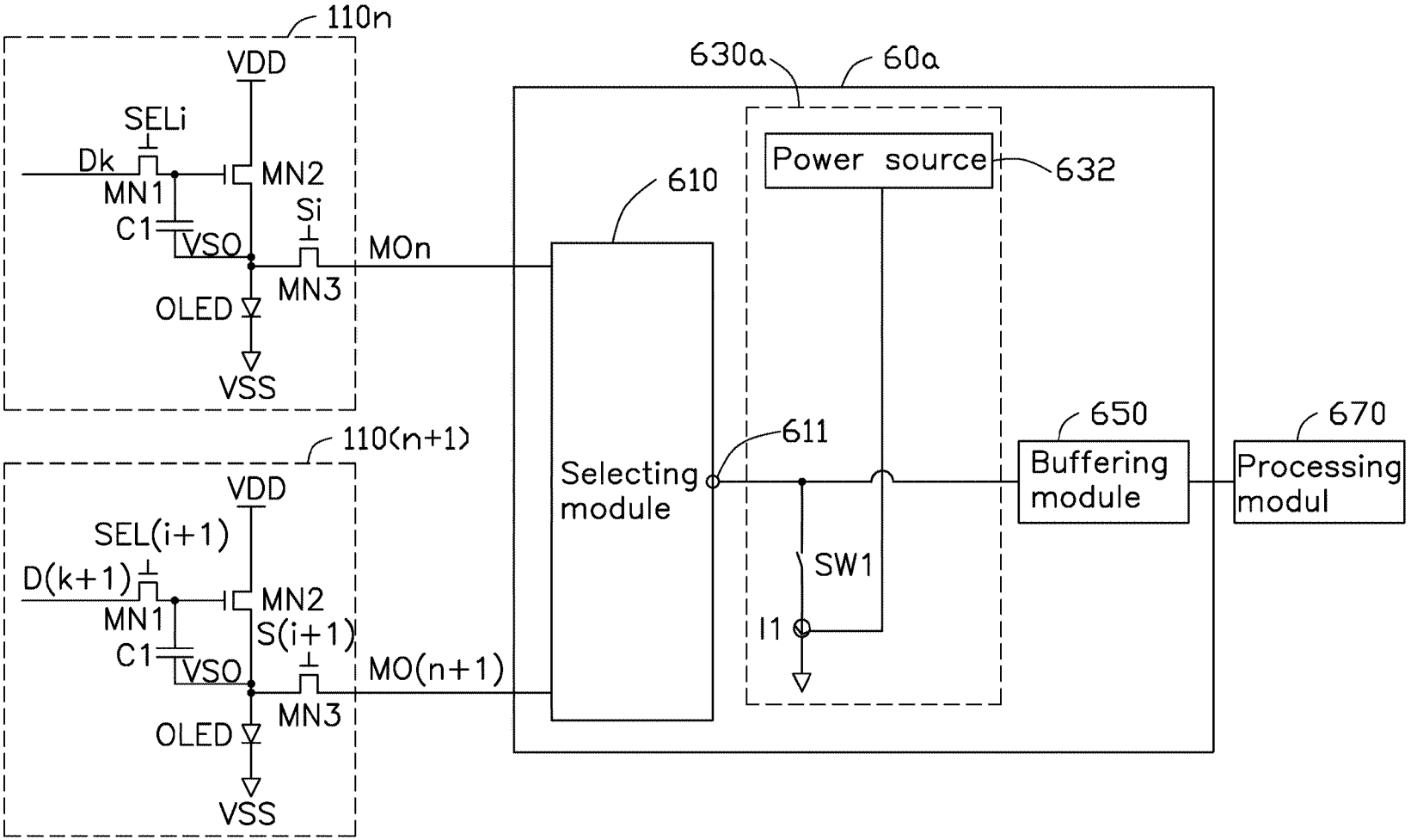
FIG. 2 is a circuit diagrammatic view of an embodiment of the pixel driving circuits and the driving control circuit of FIG. 1.

FIG. 1 illustrates a display apparatus 1 of an embodiment, while FIG. 2 is a detailed circuit diagrammatic of a pixel driving circuit 110 and a compensating circuit 60*a* for the display apparatus 1. The display apparatus 1 includes a plurality of selecting lines SEL1-SELi, a plurality of read lines S1-Si, a plurality of data lines D1-Dk, and a plurality of monitoring lines MO1-MOk. In this embodiment, i and k are integers, and m is an even number. The selecting lines SEL1-SELi and the data lines D1-Dk are arranged as a grid to define a plurality of pixel units 10 at the crossed-line portions. Pixel units 10 are located in a display region (not labeled) on a thin film transistor substrate (not shown). The selecting lines SEL1-SELi and the read lines S1-Si are alternately parallel with each other along a first direction X. Each of the read lines S1-Si is located between two adjacent selecting lines SEL1-SELi. The data lines D1-Dk and the monitoring lines MO1-MOk are alternately parallel with each other along a second direction Y, perpendicular to the first direction X. Each of the monitoring lines MO1-MOk is located between two adjacent data lines D1-Dk. Each of the monitoring lines MO1-MOk is electrically connected to the pixel units 10 in one column. Each pixel unit 10 includes a pixel driving circuit 110 (see FIG. 2). The pixel driving circuit 110 alternately operates during a detecting time period and a displaying period. The display apparatus 1 further includes a driving control circuit 100 located in a peripheral area (not labeled) around the pixel units 10. The driving control circuit 100 includes a gate driver 20, a source driver 30, a compensating circuit 60, and a controller 80. Each pixel unit 10 is electrically connected to the gate driver 20 through one of the read lines S1-Si and one of the selected lines SEL1-SELi, is electrically connected to the source driver 30 through one of the data lines D1-Dk, and is further electrically connected to the compensating circuit 60 through one of the monitoring lines MO1-MO*k*. The selecting lines SEL1-SELi respectively apply pulse signals to corresponding pixel units 10 for scanning the pixel units 10 in each row. The read lines S1-Si respectively apply pulse signals to the pixel units 10. The data lines D1-Dk provides data signals to the corresponding pixel unit 10, which indicates luminance or brightness of a light emitting element in the pixel unit 10. In an embodiment, the display apparatus 1 can be an electro luminescence (EL) type display apparatus. The controller 80 receives a compensating signal, and outputs control signals to the gate driver 20 and the source driver 30, and clock synchronization signals. The control signals include scan control signals and read control signals. The source driver 30 compensates a voltage on the data line based on the received compensating signal. In this embodiment, the display apparatus 1 includes a 2*2 matrix pixel units 10.

In the embodiment, the detecting time period can be an initial period of the display apparatus 1 being powered on. In other embodiment, the detecting time period is a blanking time period between two adjacent display frames. In this embodiment, FIG. 2 only shows two adjacent pixel driving circuits 110*k*-110(*k*+1) and the connected compensating circuit 60*a*.

The compensating circuit 60 sequentially selects one of the pixel driving circuit 110*k*, charges the selected pixel driving circuit 110 through the corresponding monitoring line MOm using a constant current during the detecting time period, detects a threshold voltage of a driving transistor in the selected pixel driving circuit 110 for generating a compensating signal to the controller 80. The compensating signal is used for compensating the threshold voltage of the driving transistor. In other embodiments, the driving control circuit 100 further includes an interfacing circuit (not shown), the compensating circuit and the interfacing circuit can be integrated in an analog-to-data converter (ADC) chip. The interfacing circuit establishes a transmitting path between the compensating circuit and a controller for transmitting signals. For example, the interfacing circuit can be a low voltage differential signaling (LVDS) interfacing circuit or a serial peripheral interface (SPI). The controller receives specified threshold voltage parameter from the compensating circuit, and outputs scan control signals for the scan lines, data driving signals for the data lines, and clock synchronization signals for the ADC chip. The source driver compensates the driving voltage provided to the data lines based on the compensating signal. The compensating circuit is served as an active front end (AFE) of the ADC chip.

The compensating circuit 60 includes a selecting module 610, a pre-charge module 630, a buffering module, and a processing module 670.

The selecting module 610 is electrically connected to the pixel driving circuits 110. The selecting module 610 sequentially selects one of the entire pixel driving circuits 110. In the embodiment, the selecting module 610 is a multiplexer.

The pre-charge module 630 charges the selected pixel driving circuit 110.

The buffering module 650 is electrically connected to the selecting module 610, and buffers the sensed threshold voltage of the pixel driving circuits 110 after the pixel driving circuits 110 being charged.

The processing module 670 is electrically connected to the buffering module 650. The processing module 670 generating a compensating signal to the controller 80 for compensating the threshold voltage of the driving transistor MN2 based on the sensed voltage in the buffering module 650.

FIG. 2 illustrates a first embodiment of two adjacent pixel driving circuits 110*k*-110(*k*+1) and the compensating circuit 60*a*. The pixel driving circuit 110*k* is electrically connected to the compensating circuit 60*a* through the corresponding monitoring line MOn, and the pixel driving circuit 110(*k*+1) is electrically connected to the compensating circuit 60*a* through the corresponding monitoring line MO(k+1). Each of the two adjacent pixel driving circuits 110*k*-110(*k*+1) is in a same circuit structure, and includes a first power line VDD, a switching transistor MN1, a driving transistor MN2, a reset transistor MN3, a storage capacitor C1, an OLED, and a ground terminal VSS. A leakage current and a noise current may occur in the pixel driving circuit 110. In this embodiment, the switching transistor MN1, the driving transistor MN2, and the reset transistor MN3 can be poly-silicon thin film transistors, amorphous silicon thin film transistors, or organic thin film transistors.

A gate electrode of the switching transistor MN1 is electrically connected to the corresponding selecting line Si, a drain electrode of the switching transistor MN1 is electrically connected to the corresponding data line Dk, and a source electrode of the switching transistor MN1 is electrically connected to a gate electrode of the driving transistor MN2. A drain electrode of the driving transistor MN2 is electrically connected to the first power line VDD, and a source electrode of the driving transistor MN2 is electrically connected to an anode of the OLED through a node VSO. A cathode of the OLED is electrically connected to the ground terminal VSS. A gate electrode of the reset transistor MN3 is electrically connected to the read line Si, a source electrode of the reset transistor MN3 is electrically connected to the node VSO, and a drain electrode of the reset transistor MN3 is electrically connected to the compensating circuit 60*a* through a corresponding monitoring line MOm. In other words, the source electrode of the reset transistor MN3 is electrically connected between the source electrode of the driving transistor MN2 and the anode of the OLED. A terminal of the storage capacitor C1 is electrically connected to the gate electrode of the driving transistor MN2, and the other terminal of the storage capacitor C1 is electrically connected to the source electrode of the driving transistor MN2. In this embodiment, the switching transistor MN1 is served as a switch element in the pixel driving circuit 110, the driving transistor MN2 is served as a driving element in the pixel driving circuit 110 for driving the OLED, and the reset transistor MN3 is served as a reset element in the pixel driving circuit 110 for resetting the potential of the storage capacitor C1.

The selecting module 610 includes an input/output terminal 611. The input/output terminal 611 is electrically connected to the buffering module 650. The input/output terminal 611 is served as an input terminal for providing a constant current to the node VSO in pixel driving circuit 110 during the detecting time period, and is served as an output terminal for outputting sensing voltage or sensing current to the buffering module 650.

The pre-charge module 630*a* charges the storage capacitor C1 in the selected pixel driving circuit 110. The pre-charge module 630*a* is electrically connected to the selecting module 610. The pre-charge module 630*a* includes a power source 632, a current mirror I1, and a first switch SW1. The power source 632 is electrically connected to the current mirror I1, and provides a first voltage to the current mirror I1. The first switch SW1 is electrically connected between the input/output terminal 611 and the current mirror I1.

In detail, during the detecting time period, when the selecting module 610 selects the Nth pixel driving circuit 110*k*, the switching transistor MN1 turns on, and the reset transistor MN3 turns on. The first switch SW1 turns on.

Thus, the current from the current mirror I1 is provided to the node VSO through the first switch SW1, the selecting module 610, and the reset transistor MN3. The potential of the node VSO is being charged to a specified voltage, which is equal to a potential of a lower conductive plate of the storage capacitor C1 connected to the node VSO. The specified voltage is less than 7 volts (V). In the embodiment, the specified voltage is 6 V.

As described above, the compensating circuit 60*a* charges the pixel driving circuit 110 before detecting the threshold voltage of the pixel driving circuit 110, a time of the detecting time period is decreased, and a time of the display apparatus 1 being steadily operated is increased.

Figure 3:
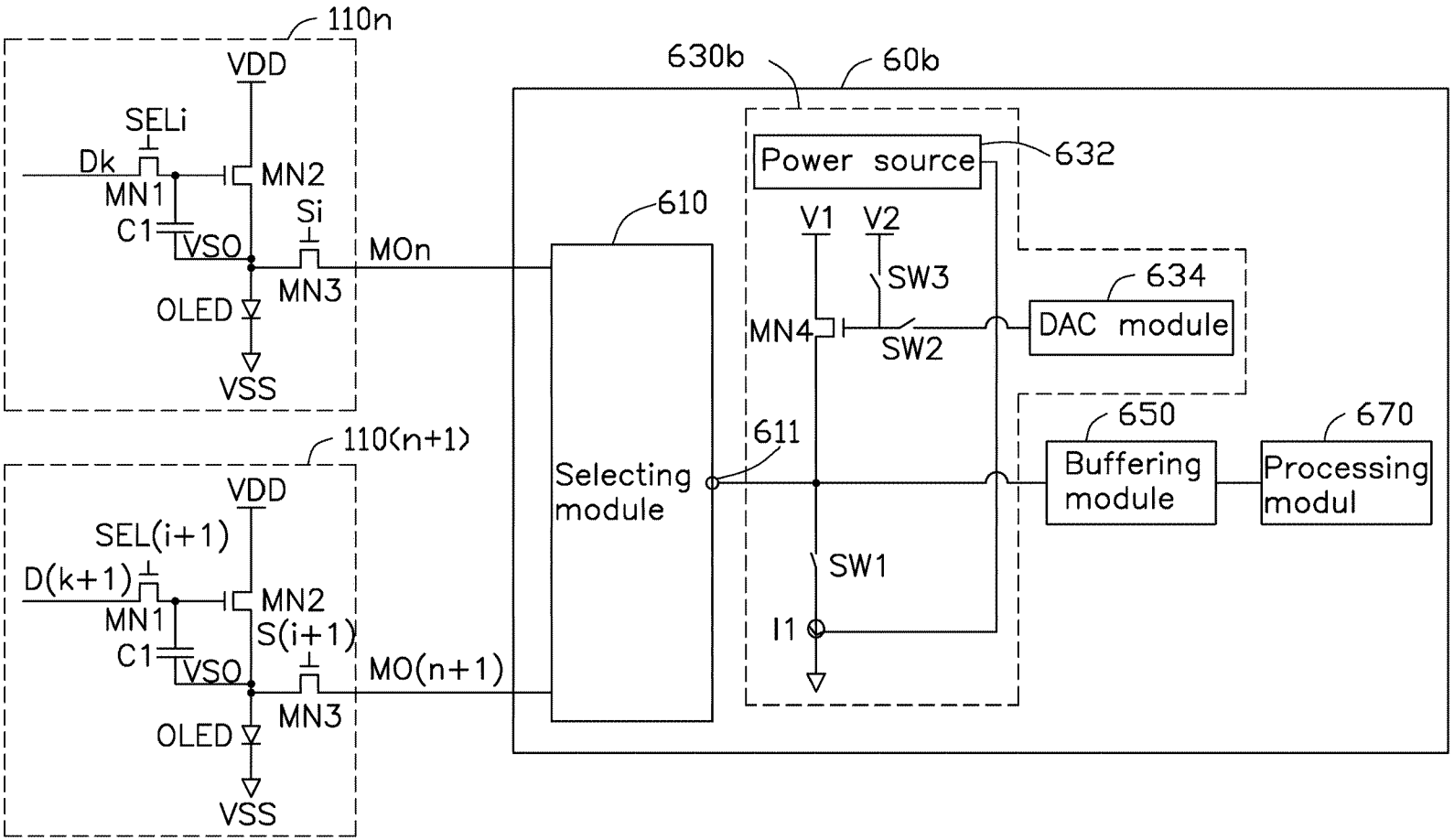
FIG. 3 is a circuit diagrammatic view of another embodiment of the pixel driving circuits and the driving control circuit of FIG. 1, the driving control circuit comprises a first switch, a second switch, and a third switch.

FIG. 3 illustrates a second embodiment of a circuit diagrammatic view of the pixel driving circuit 110 and the compensating circuit 60*b*. The compensating circuit 60*b* is similar to the compensating circuit 60*a*. Elements in FIG. 3 with the same labels are the same as the elements in FIG. 1. The difference between the compensating circuit 60*b* and the compensating circuit 60*a* is the pre-charge module 630*b*.

The selecting module 610 is electrically connected to the entire pixel driving circuits 110. The selecting module 610 includes an input/output terminal 611. The input/output terminal 611 is electrically connected to the buffering module 650. The input/output terminal 611 is served as an input terminal for providing a constant current to the node VSO in pixel driving circuit 110 during the detecting time period, and is served as an output terminal for outputting sensing voltage or sensing current to the buffering module 650.

Figure 4:
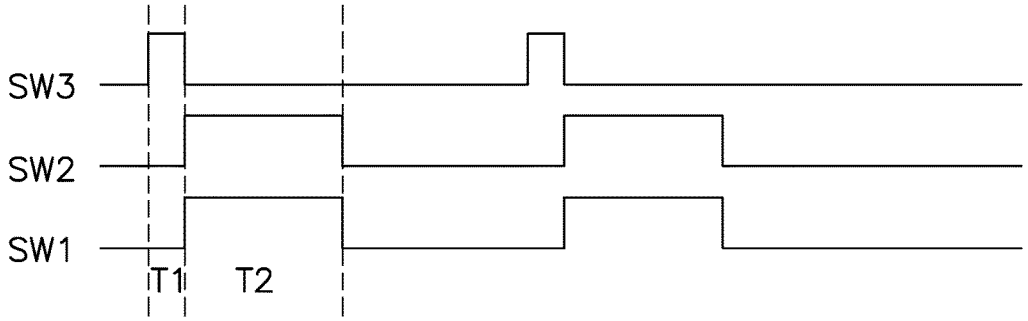
FIG. 4 is a state diagrammatic view of the first switch, the second switch, and the third switch of FIG. 3.

The pre-charge module 630*b* charges the corresponding monitoring line MOm and the corresponding pixel driving circuit 110. The pre-charge module 630*b* sequentially operates during a first sub-period T1 (as shown in FIG. 4) and a second sub-period T2 (as shown in FIG. 4) in turn. The pre-charge module 630*b* charges the corresponding monitoring line MOm during the first sub-period T1, and charges the corresponding pixel driving circuit 110 during the second sub-period T2. The pre-charge module 630*a* is electrically connected to the selecting module 610. The pre-charge module 630*b* includes a power source 632, a second power line V2, a third power line V3, a first transistor MN4, a current mirror I1, a first switch SW1, a second switch SW2, a third switch SW3, and a digital-to-analog converter (DAC) module 634. A gate electrode of the first transistor MN4 is electrically connected to the DAC module 634 through the second switch SW2, a source electrode of the first transistor MN4 is electrically connected to the second power line V2, and a drain electrode of the first transistor MN4 is electrically connected to the current mirror I1 through the first switch SW1. The input/output terminal 611 is electrically connected to the drain electrode of the first transistor MN4. A terminal of the third switch SW3 is electrically connected to the third power line V3, and the other terminal of the third switch SW3 is electrically connected between the gate electrode of the first transistor MN4 and the second switch SW2. The second power line V2 provides a specified voltage. The DAC module 634 is capable of providing a first reference voltage and a second reference voltage to the gate electrode of the first transistor MN4.

The buffering module 650 is electrically connected to the selecting module 610, and buffers the sensed threshold voltage of the pixel driving circuits 110 after the pixel drivint circuits 110 being charged.

The processing module 670 is electrically connected to the buffering module 650. The processing module 670 generating a compensating signal to the controller 80 for compensating the threshold voltage of the driving transistor MN2 based on the sensed voltage in the buffering module 650.

FIG. 4 illustrates states of the first switch SW1, second switch SW2, and the third switch SW3 during the detecting time period. The high level indicates the turn-on state, and the low level indicates the turn-off state.

In detail, during the first sub-period T1 of the detecting time period, when the selecting module 610 selects the Nth pixel driving circuit 110*k*, the third switch SW3 turns on, and the first switch SW1 and the second switch SW2 turn off, which cause the first transistor MN4 to be turned on. The third power line V3 charges the monitoring line MOm through the first transistor MN4 and the selecting module 610, which cause the reset transistor MN3 to be turned on.

During the second sub-period T2 of the detecting time period, the third switch SW3 turns off, the first switch SW1 and the second switch SW2 turn on, the DAC module 634 provides the first reference voltage to the gate electrode of the first transistor MN4, which cause the first transistor MN4 to be saturated. The current mirror I1 generating the constant current based on the voltage provided by the power source 632. The constant current is provided to the node VSO through the first switch SW1 for pre-charging the storage capacitor C1.

After the second sub-period T2 of the detecting time period, the DAC module 634 provides the second reference voltage to the gate electrode of the first transistor MN4, which cause the first transistor MN4 to be turned off.

As the described above, the compensating circuit 60*b* charges the pixel driving circuit 110 before detecting the threshold voltage of the pixel driving circuit 110, a time of the detecting time period is decreased, and a time of the display apparatus 1 being steadily operated is increased. Further, the compensating circuit 60*b* charges the corresponding monitoring line MOm, a time of the detecting time period is further decreased and a time of the display apparatus 1 being steadily operated is further increased.

Figure 5:
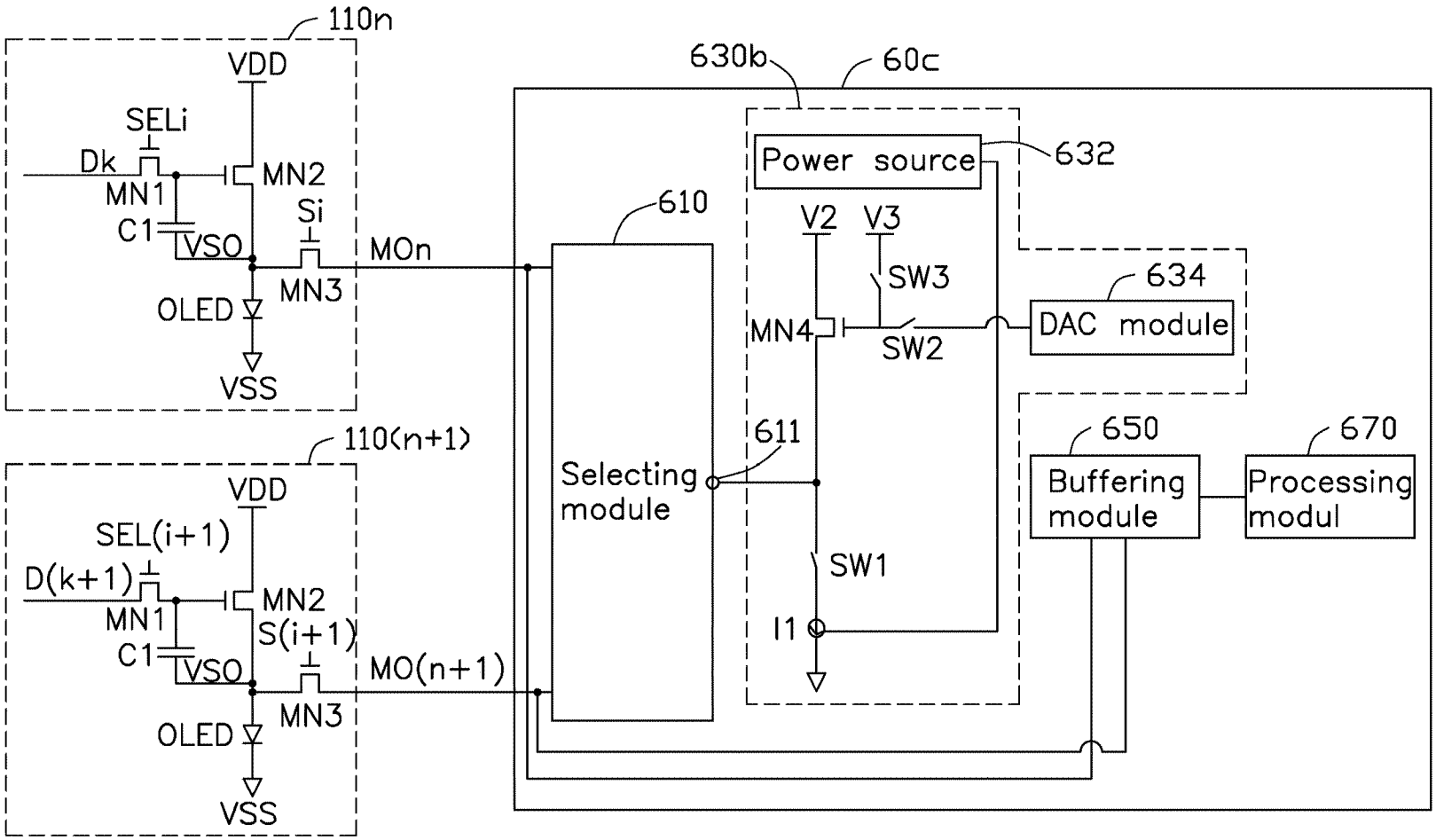
FIG. 5 is a circuit diagrammatic view of another embodiment of the pixel driving circuits and the driving control circuit of FIG. 1.

FIG. 5 illustrates a third embodiment of a circuit diagrammatic view of the pixel driving circuit 110 and the compensating circuit 60*c*. The compensating circuit 60*c* is similar to the compensating circuit 60*b*. Elements in FIG. 5 with the same labels are the same as the elements in FIG. 4. The difference between the compensating circuit 60*c* and the compensating circuit 60*b* is number of the selecting module 610, the number of the pre-charge module 630*b*, and the connection of the buffering module 650.

The compensating circuit 60*c* includes a plurality of selecting module 610 and a plurality of pre-charge module 630*b*. Each selecting module 610 is electrically connected to two adjacent pixel driving circuits 110. Each selecting module 610 sequentially selects one of the two connected pixel driving circuits 110, and charges the selected pixel driving circuit 110. Each selecting module 610 includes an input/output terminal 611. The input/output terminal 611 is served as an input terminal for providing a constant current to the node VSO in pixel driving circuit 110 during the detecting time period.

As the described above, the compensating circuit 60*b* charges the pixel driving circuit 110 before detecting the threshold voltage of the pixel driving circuit 110, a time of the detecting time period is decreased, and a time of the display apparatus 1 being steadily operated is increased. Further, the compensating circuit 60*b* charges the corresponding monitoring line MOn, a time of the detecting time period is further decreased and a time of the display apparatus 1 being steadily operated is further increased. Further, the selecting operation of the selecting module 610 is simple, and the buffering module 650 directly receives the sensed threshold voltage and the sensed voltage form the pixel driving circuit 110.

While various embodiments have been described above, the disclosure is not limited thereto. On the contrary, various modifications and similar arrangements (as would be apparent to those skilled in the art) are also intended to be covered. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A driving control circuit for detecting a threshold voltage of at least one pixel driving circuit in a display apparatus to generate a compensating signal, the at least one pixel driving circuit sequentially operating during a detecting time period and a displaying period;

each at least one pixel driving circuit comprising:

a driving transistor; and an organic light emitting diode (OLED) connected to a drain electrode of the driving transistor, thereby defining a node between the drain electrode of the driving transistor and the OLED;

the driving control circuit comprising:

a compensating circuit configured to detect a threshold voltage of the driving transistor of the at least one selected pixel driving circuit, and generate the compensating signal for compensating the threshold voltage during the detecting time period;

wherein the compensating circuit comprises a selecting module and a pre-charge module, the selecting module establishes an electronic connection between one of the at least one pixel driving circuit and the pre-charge module; the pre-charge module charges the at least one selected pixel driving circuit with a constant current before a detection operation during the detecting time period;

wherein the pre-charge module comprises a power source, a current mirror, and a first switch; the power source is electrically connected to the current mirror and provides a first voltage to the current mirror; the first switch electrically connects an output of the selecting module and the current mirror; during the detecting time period, the first switch turns on, the current mirror provides the constant current to charge the node of the at least one selected pixel driving circuit based on the first voltage from the power source.

2. The driving control circuit of claim 1, wherein each of the at least one pixel driving circuit further comprises a reset transistor, a first terminal of the reset transistor connects to the OLED and a second terminal of the reset transistor connects to a monitoring line, wherein during the detecting time period, the selecting module connects to one of the at least one pixel driving circuits by corresponding monitoring lines, the pre-charge module sequentially operates during a first sub-period and a second sub-period; during the first sub-period, the pre-charge module charges the monitoring line corresponding to the at least one selected pixel driving circuit by the monitoring line for turning on the reset transistor; during the second sub-period, the pre-charge module charges the node in the at least one selected pixel driving circuit.

3. The driving control circuit of claim 2, wherein the pre-charge module comprises a power source, a second power line, a third power line, a first transistor, a current mirror, a first switch, a second switch, a third switch, and a digital-to-analog converter (DAC) module; a gate electrode of the first transistor electrically connects to the DAC module through the second switch, a source electrode of the first transistor electrically connects to the second power line, and a drain electrode of the first transistor electrically connects to the current mirror through the first switch; the selecting module electrically connects to the drain electrode of the first transistor; a terminal of the third switch electrically connects to the third power line, and the other terminal of the third switch electrically connects the gate electrode of the first transistor and the second switch.

4. The driving control circuit of claim 3, wherein during the first sub-period, the third switch turns on, the first switch and the second switch turn off, and the first transistor turns on; the third power line charges the corresponding monitoring line through the first transistor and the selecting module.

5. The driving control circuit of claim 3, wherein the DAC module is capable of providing a first reference voltage and a second reference voltage to the gate electrode of the first transistor; during the second sub-period, the third switch turns off, and the first switch and the second switch turn on, the DAC module provides the first reference voltage, and the first transistor becomes saturated, the current mirror generates the constant current to the at least one selected pixel driving circuit based on the voltage provided by the power source; after the second sub-period, the DAC module provides the second reference voltage to the first transistor, and the first transistor turns off.

6. The driving control circuit of claim 1, wherein the compensating circuit further comprises a buffering module and a processing module; the buffering module buffers a voltage from the corresponding at least one pixel driving circuit after being charged for a predetermined time; the processing module generates a compensating signal to a controller for compensating the threshold voltage of the corresponding at least one pixel driving circuit based on the buffered voltage of the buffering module.

7. The driving control circuit of claim 1, wherein the compensating circuit serves as an active front end (AFE) of the ADC chip.

8. The driving control circuit of claim 1, wherein the detecting time period is a blanking time period.

9. The driving control circuit of claim 1, wherein the detecting time period is an initial period during which the display apparatus is powered on.

10. A display apparatus comprising:

a plurality of pixel driving circuits; and a driving control circuit configured to drive the plurality of pixel driving circuits;

wherein the driving control circuit comprises a compensating circuit; each of the plurality of pixel driving circuits sequentially operates during a detecting time period and a displaying period; each pixel driving circuit comprises a driving transistor and an organic light emitting diode (OLED); during the detecting time period, the compensating circuit charges a node by a constant current for decreasing a time of the detecting time period, the node is connected between a terminal of the driving transistor and the OLED in each of the plurality of the pixel driving circuits, and wherein the compensating circuit comprises a pre-charge module, the pre-charge module comprises a power source, a current mirror, and a first switch; the power source is electrically connected to the current mirror and provides a first voltage to the current mirror; the first switch electrically connects an output of the selecting module and the current mirror; during the detecting time period, the first switch turns on, the current mirror provides the constant current to charge the node of the at least one selected pixel driving circuit based on the first voltage from the power source.

11. The display apparatus of claim 10, wherein the compensating circuit further comprises a selecting module; the selecting module electrically connects to the plurality of pixel driving circuits; the selecting module sequentially selects one of the pixel driving circuits, and the pre-charge module charges the node in the selected pixel driving circuit before a detection operation in the detecting time period.

12. The display apparatus of claim 11, wherein during the detecting time period, the pre-charge module sequentially operates during a first sub-period and a second sub-period; during the first sub-period, the pre-charge module charges the monitoring line corresponding to the selected pixel driving circuit; during the second sub-period, the pre-charge module charges the node in the selected pixel driving circuit.

13. The display apparatus of claim 10, wherein the compensating circuit comprises a plurality of selecting modules and a plurality of pre-charge modules, each selecting module electrically connects with two adjacent pixel driving circuits, and electrically connects to one of the pre-charge module; each selecting module sequentially selects one of the plurality of the pixel driving circuits, and charges the selected pixel driving circuit.

14. The display apparatus of claim 10, wherein the detecting time period is a blanking time period between two adjacent image display frames.

15. The display apparatus of claim 10, wherein the detecting time period is an initial period of the display apparatus being powered on.

16. A driving control circuit for detecting a threshold voltage of at least one pixel driving circuit, the at least one pixel driving circuit sequentially operating during a detecting time period and a displaying period;

the at least one pixel driving circuit comprising:

a driving transistor; and an organic light emitting diode (OLED) connected to a drain electrode of the driving transistor, thereby defining a node between the drain electrode of the driving transistor and the OLED;

the driving control circuit comprising:

a compensating circuit configured to detect the threshold voltage of the driving transistor of the at least one pixel driving circuit and generate a compensating signal for compensating the threshold voltage;

wherein the compensating circuit comprises a pre-charge module, the pre-charge module generates a constant current and charges the node by the constant current in the at least one pixel driving circuit before a detection operation in the detecting time period, wherein the pre-charge module comprises a power source, a current mirror, and a first switch; the power source is electrically connected to the current mirror and provides a first voltage to the current mirror; the first switch electrically connects an output of the selecting module and the current mirror; during the detecting time period, the first switch turns on, the current mirror provides the constant current to charge the node of the at least one selected pixel driving circuit based on the first voltage from the power source.

* * * * *